US009175441B2

(12) United States Patent
Heiskanen et al.

(10) Patent No.: US 9,175,441 B2
(45) Date of Patent: Nov. 3, 2015

(54) PROCESS FOR THE PRODUCTION OF A PAPER OR BOARD PRODUCT AND A PAPER OR BOARD PRODUCED ACCORDING TO THE PROCESS

(75) Inventors: Isto Heiskanen, Imatra (FI); Lars Axrup, Hammarö (FI); Risto Laitinen, Imatra (FI)

(73) Assignee: Stora Enso OYJ, Helsinki (FI)

( * ) Notice: Subject to any disclaimer, the term of this patent is extended or adjusted under 35 U.S.C. 154(b) by 255 days.

(21) Appl. No.: 13/505,704

(22) PCT Filed: Nov. 4, 2010

(86) PCT No.: PCT/SE2010/051204

§ 371 (c)(1), (2), (4) Date: May 2, 2012

(87) PCT Pub. No.: WO2011/056135

PCT Pub. Date: May 12, 2011

(65) Prior Publication Data

US 2012/0219816 A1 Aug. 30, 2012

Related U.S. Application Data

(60) Provisional application No. 61/258,713, filed on Nov. 6, 2009.

(51) Int. Cl.

| | |
|---|---|
| ***D21H 19/34*** | (2006.01) |
| ***D21H 19/18*** | (2006.01) |
| *D21H 19/52* | (2006.01) |
| *D21H 19/54* | (2006.01) |
| *D21H 27/30* | (2006.01) |

(52) U.S. Cl.

CPC ..... *D21H 19/34* (2013.01); *D21H 19/18* (2013.01); *D21H 19/52* (2013.01); *D21H 19/54* (2013.01); *D21H 27/30* (2013.01); *Y10T 428/31982* (2013.01)

(58) Field of Classification Search

USPC ..... 162/27

See application file for complete search history.

(56) References Cited

U.S. PATENT DOCUMENTS

| | | | | |
|---|---|---|---|---|
| 5,964,983 | A | 10/1999 | Dinand et al. | |
| 2003/0000665 | A1 * | 1/2003 | Takai et al. | 162/115 |

FOREIGN PATENT DOCUMENTS

| | | |
|---|---|---|
| JP | H10-292281 | 11/1998 |
| JP | H10-331093 | 12/1998 |
| JP | 2001-288692 | 10/2001 |
| JP | 2003-147699 | 5/2003 |
| JP | 2005096845 | 4/2005 |
| WO | 2004055267 | 7/2004 |
| WO | 2008076056 | 6/2008 |
| WO | 2009-122982 | 8/2009 |

OTHER PUBLICATIONS

International Search Report and Written Opinion of the International Searching Authority (PCT/SE2010/051240), Feb. 10, 2011.

Syverud et al, "Strength and barrier properties of MFC films." In: Cellulose (2009), vol. 16, No. 1, pp. 75-85.

* cited by examiner

*Primary Examiner* — Jacob Thomas Minskey

(74) *Attorney, Agent, or Firm* — Greer, Burns & Crain, Ltd.

(57) ABSTRACT

The present invention relates to a process for the production of a paper or paperboard comprising at least two plies wherein microfibrillated cellulose is added to the surface of a first ply and the other ply is attached to the first ply so that the microfibrillated cellulose located in between the plies. The invention further relates to a paper or board produced according to the method.

20 Claims, No Drawings

PROCESS FOR THE PRODUCTION OF A PAPER OR BOARD PRODUCT AND A PAPER OR BOARD PRODUCED ACCORDING TO THE PROCESS

This application is a U.S. National Phase under 35 U.S.C. §371 of International Application No. PCT/SE2010/051204, filed Nov. 4, 2010, which claims priority under 35 U.S.C. §119(e) to U.S. Provisional Application No. 61/258,713, filed Nov. 6, 2009.

FIELD OF INVENTION

The present invention relates to a process for the production of a paper or board comprising at least two plies in which microfibrillated cellulose is added between the plies in order to increase bonding of the plies. The invention further relates to a paper or board product.

BACKGROUND

Cartonboards made from cellulosic fibers are often made of three or in some cases four plies. Typically, the top and back plies are made from chemical pulp. Mechanical pulps such as groundwood, pressure groundwood, thermomechanical pulp (TMP), chemimechanical pulp (CTMP), alkaline peroxide mechanical pulp (APMP) and machine broke are often used in the middle ply or plies of the cartonboard. The mechanical pulp or low refined chemical pulp is used in the middle ply in order to give the highest possible bulk. Also, basis weight of the top and back plies is minimized in order to achieve high bulk and also for decreasing raw material costs.

Cartonboard can be used for production of folding board. A basic requirement for a folding board is a certain level of mechanical strength and stiffness. Bending stiffness for certain smoothness levels, and especially cross machine direction bending stiffness, is critical. Bending stiffness is affected mainly by thickness of the board and modulus of elasticity given by the raw material in it. The optimal structure is when the middle ply has high bulk and the top and back plies have high modulus of elasticity. The lower the basis weight that can be achieved at a given stiffness, the better the yield. When this is fulfilled, more area, i.e. paper or board, can be produced from the same weight of pulp.

When the board is creased, there are tensile, compression and shear forces acting on the board. Cracking of the board surface should be avoided and the cracking tendency is also affected by the board structure. In order to minimize the cracking tendency, the stretch to break of the top ply should be as big as possible. Also, z-direction strength is important. If the z-strength is too low, the board can delaminate during printing operations. On the other hand, if the z-strength is too high, cracking can occur since the stretch is too big for the top ply if the middle ply does not delaminate in creasing.

The forming section of a board machine typically provides separate forming of individual plies with fourdrinier rolls. A middle-ply fourdrinier is often equipped with a top dewatering unit in order to improve formation and increase drainage capacity.

Fines and filler distribution of the sheet in z-direction depends heavily of the dewatering of the wet web. It depends on, for example, if the dewatering is done in one direction (fourdrinier) or two directions (twin wire or MB-type of former). Furthermore, the side part of the web, which is where water was taken out, typically contains fewer fines, i.e. this side is washed clean from fines.

If several wet sheets are wet couched together, the weakest point of the board is typically between different plies due to low fines content and more open structure in this point. This leads to a situation where the board is delaminated during creasing of the different plies, thus causing imperfect crease which can lead to cracking during the converting operations.

In the prior art there are several ways to handle these problems.

One way is by increasing the top and bottom ply grammage. In this way, top and bottom ply strength is increased which thus will prevent cracking tendency. The disadvantage with this is that cost increases due to increased chemical pulp usage and reduced bending stiffness index, i.e. the structure is not optimized seeing to bending stiffness.

Another way is by increasing refining of the pulp in the middle ply. Increased refining increases the amount of fines present which leads to increased amount of fines located between the different plies. However, this unfortunately reduces the caliper of the board and thus also reduces the bending stiffness index.

Yet another way is by decreasing the amount of water taken from the middle ply top dewatering unit. This results in that fewer fines are taken from the middle ply. However, it unfortunately decreases formation.

The most commonly used way to solve the problems discussed above, is to spray starch between the plies before couching the plies together. Unfortunately, starch forms very un-stretching bonds between the plies which increases cracking tendency of the board.

There is thus a need for an improved process for the production of a multi-ply board with decreased cracking tendency at the same time as delamination of the plies of the board is avoided or reduced.

SUMMARY OF INVENTION

The object of the present invention is to provide a process for the production of a multi-ply board having increased bond between the plies and thus reduced tendency of cracking and/or delamination.

This object, as well as other objects and advantages, is achieved by a process for the production of a paper or board comprising at least two plies wherein the process comprises the steps of providing a first ply, adding microfibrillated cellulose to a surface of the first ply, providing a second ply and attaching the second ply to the first ply so that the added microfibrillated cellulose is located in between the first and second plies. It has been shown that addition of microfibrillated cellulose between the plies of a paper or board product increases the bond of the plies and reduces cracking and/or delamination of the product.

The microfibrillated cellulose in preferably added in an amount of 0.1-5 gsm (as dry) to the surface of the first ply. The amount of microfibrillated cellulose depends on the properties of the plies, such as thickness, fiber content etc.

The paper or board preferably comprises at least three plies. However, four, five, six or more plies are also possible.

If the paper or board comprises at least three plies, the microfibrillated cellulose is preferably added to at least two surfaces of the plies so that microfibrillated cellulose is being located between the plies of the paper or board.

The solid of the paper or board ply is preferably between 7-13% by weight before the microfibrillated cellulose is added.

The microfibrillated cellulose is preferably added by spraying. It is preferred to add the microfibrillated cellulose by spraying a solution comprising microfibrillated cellulose to the ply or plies. In this way it is easy to control the addition of the microfibrillated cellulose at the same time as it is a fast process step.

The microfibrillated cellulose may only be added to a part of a surface of a ply. It is possible to add the microfibrillated cellulose to only the parts of the surface of the ply or plies where the bond needs to be increased.

The microfibrillated cellulose may be added to the surface of the ply or plies in more than one step, thus forming at least two layers of microfibrillated cellulose between the plies. In this way it is possible to increase the amount of microfibrillated cellulose added to the surface of the ply or plies. The strength between the plies can thus be even further increased. Furthermore, it is possible to add microfibrillated cellulose with different charge, for example to first add an anionic MFC followed by a cationic MFC.

At least one additive, preferably a filler or a strength enhancer, such as clay, bentonite, silica and/or crosslinker, may be added separately or together with the microfibrillated cellulose to the surface of at least one ply. Starch may also be added separately or together with the microfibrillated cellulose to the surface of at least one ply. In this way it is possible to create an even stronger bond between the plies.

The present invention further relates to a paper or board produced according to the process described above. The produced product will have reduced delamination tendencies and increased bonding between the plies.

DETAILED DESCRIPTION OF THE INVENTION

The present invention relates to a process for the production of a paper or board comprising at least two plies, i.e. a multi-ply paper or board product. Microfibrillated cellulose (MFC) is added between at least two plies in order to reduce the delamination between the different plies of the paper or board. The addition of MFC gives a much more flexible structure compared to products to which starch has been added between plies as described in prior art. Consequently, the increased flexibility of the structure will improve the flexibility of the paper or board product during creasing and/or folding. Due to the increased flexibility the cracking and/or delamination of the product is reduced. Furthermore, the addition of microfibrillated cellulose (MFC) between the plies (layers) of the paper or board product increases the bond between the plies which also contributes to reduced delamination and/or cracking.

The MFC is added between two or several plies of the paper or paperboard. It is preferred that the MFC is added to at least one surface of at least one of the plies and another ply is attached to the ply comprising microfibrillated cellulose so that the microfibrillated cellulose is located in between the plies. When three plies is used, the MFC is either added to both surfaces of the ply located in the middle or to one surface of two different plies, so that the MFC is being located in between the plies. It is preferred that microfibrillated cellulose is added between all plies of the paper or board product and thus increasing the bond between all plies increasing the strength and reducing delamination of the product.

The MFC is preferably added to the ply in the forming section, typically after the water line just before the different plies are being couched together. The web solids may be about 7-13% by weight when the couching is done. This solid has been shown to be favorable when couching two fiber based webs together. The added MFC acts as a bonding agent between the different plies. However, it may also be preferred to add MFC at the wet end.

The MFC can preferably be added by spraying a solution comprising MFC to the surface of the ply. It is also possible to add the microfibrillated cellulose by the use of a fines headbox or by the use of any other known method in order to apply a solution comprising small materials such as MFC to a surface, for example by ink-jet or coating equipment, such as curtain coating.

The MFC is preferably optimized in order to increase the fiber bonding between the different paper or board plies.

Another big advantage with the present invention is that the MFC can be dosed exactly where the bond between two plies will be poor. For example where the amount of fines is low or where fines are missing in the paper or board structure. It is thus possible to increase the bonding between the plies locally, where needed. By measuring the z-strength and/or Scott bond of the paper or board it is possible to evaluate where the breaking point in z-direction is located. In this way it is possible to locate where the MFC shall be added in order to increase the strength of the produced paper or board product. The amount of MFC added can thus be reduced which also will reduce costs and it is also possible to produce a paper or board product with improved strength and reduced tendency of both delamination and cracking.

Furthermore, it is possible to dose the MFC with different solids onto the wet web. In this way it is possible to control the absorption of the added MFC in order to avoid that MFC is totally absorbed by the web. It is preferred that the MFC stays on the surface of the web where it can work as a binder.

The microfibrillated cellulose may be added to the surface of the ply or plies in more than one step, thus forming at least two layers of microfibrillated cellulose between the plies of the paper or board. It is possible to add microfibrillated cellulose in two, three, four or more steps, thus forming multilayer of MFC between at least two plies of the paper or board. In this way it is possible to increase the amount of microfibrillated cellulose added to the surface of the ply or plies. Furthermore, it is possible to add microfibrillated cellulose with different charge, for example first an anionic MFC followed by a cationic MFC, between the ply or plies of the paper or board.

Microfibrillated cellulose (MFC) (also known as nanocellulose) is a material typically made from wood cellulose fibers (or it can also be made from microbial sources, agricultural fibers ext.), where the individual microfibrils have been partly or totally detached from each other. MFC is normally very thin (~20 nm) and the length is often between 100 nm to 10 μm. However, the microfibrils may also be longer, for example between 10-200 μm, but lengths even 2000 um can be found due to wide length distribution. Fibers that has been fibrillated and which have microfibrils on the surface and microfibrils that are separated and located in a water phase of a slurry are included in the definition MFC. Furthermore, whiskers are also included in the definition MFC.

The added amount of MFC between the plies of the paper or board are typically between 0.1-5 gsm (as dry), preferably between 0.1-2 gsm (as dry).

It is also possible to add an additive to the surface of a ply. The additive may either be added separately to the surface of a ply or added together with the MFC as a mixture. The additive is preferably a filler. Any conventional used filler may be used. In this way, it is possible to decrease the amount of filler in the paper or board plies without impairing the opacity or printing properties of the paper or board.

The additive may also be a strength enhancer which is added in small amounts, preferable in an amount of 1-10% by weight, to the surface of a ply. Small particles of bentonite, clay, silica and/or crosslinker may be used as a strength enhancer and be added to the surface of the ply either separately or together with the microfibrillated cellulose. In this way, the bond between the plies will increase. Also, the additive may form a barrier between the plies of the paper or board.

The process according to the invention will replace all or part of the sprayed starch previously used. However, it is possible to add starch, either separately or as mixture with the MFC, to the surface of the ply or plies so that it is being located between the plies. The amount of MFC may then be decreased. However, the amount of starch is kept low since high amounts of starch will reduce the elasticity of the bond between the plies.

The present invention makes it possible to reduce the refining of the pulp present in the middle ply. It is thus possible to increase the middle ply bulk which gives higher bending stiffness index of the paper or board. The present invention also makes it possible to reduce the grammage of the top and/or bottom ply since the bonding between the plies are more flexible and the top and bottom ply will thus have reduced tendency to crack. It may be possible to reduce the grammage of the top and bottom ply with several percent. It is thus also possible to optimize the board structure based on the bending stiffness index. Consequently, major cost savings, by way of reduced grammage of the paper or board product produced and by the reduced amount of a chemical pulp used, is achieved.

Another advantage is that it is possible to improve the dewatering in the top former unit by taking more water to the top direction of the middle ply. In this way, the formation of the paper or board will improve and it is possible to increase the speed of the paper or board machine if the dewatering is limiting the production rate.

In view of the above detailed description of the present invention, other modifications and variations will become apparent to those skilled in the art. However, it should be apparent that such other modifications and variations may be effected without departing from the spirit and scope of the invention.

The invention claimed is:

1. Process for the production of a paper or board comprising at least two plies wherein the process comprises the steps of;

providing a first ply, applying a layer consisting essentially of microfibrillated cellulose and optionally at least one additive selected from the group consisting of a filler, a strength enhancer, and starch to a surface of the first ply, providing a second ply and attaching the second ply to the first ply so that the layer of microfibrillated cellulose is located in between the first and second ply.

2. The process according to claim 1 wherein microfibrillated cellulose in an amount of 0.1-5 gsm (as dry) is applied to the surface of the first ply.

3. The process according to claim 1 wherein the paper or board comprises at least three plies.

4. The process according to claim 3 where the layer of microfibrillated cellulose is applied to at least two surfaces of the ply or plies so that the layers of microfibrillated cellulose are located between the plies of the paper or board.

5. The process according to claim 1 wherein the paper or board ply has a solids content of between 7-13% by weight before the layer of microfibrillated cellulose is applied.

6. The process according to claim 1 wherein the layer of microfibrillated cellulose is applied by spraying.

7. The process according to claim 1 wherein the layer of microfibrillated cellulose is applied to a part of a surface of the ply or plies.

8. The process according to claim 1 wherein the layer of microfibrillated cellulose is applied to the surface of the ply or plies in more than one step, thus forming at least two layers of microfibrillated cellulose between the plies.

9. The process according to claim 1 wherein the at least one additive is applied together with the layer of microfibrillated cellulose to the surface of the first ply, and wherein the at least one additive is clay, bentonite, silica, crosslinker, or the starch.

10. The process according to claim 1 wherein at least one second additive is applied separately from the layer of microfibrillated cellulose to at least one surface of a ply, and wherein the at least one second additive is clay, bentonite, silica, crosslinker, or starch.

11. A paper or board produced according to the process of claim 1.

12. Process for the production of a paper or board comprising at least two plies wherein the process comprises the steps of;

providing a first ply, applying a layer consisting essentially of microfibrillated cellulose and optionally at least one additive selected from the group consisting of a filler, a strength enhancer, and starch to a part of a surface of the first ply, providing a second ply and attaching the second ply to the first ply so that the layer of microfibrillated cellulose is located in between the first and second ply.

13. The process according to claim 12 wherein microfibrillated cellulose in an amount of 0.1-5 gsm (as dry) is applied to the surface of the first ply.

14. The process according to claim 12 wherein the paper or board comprises at least three plies.

15. The process according to claim 14 where the layer of microfibrillated cellulose is applied to at least two surfaces of the ply or plies so that the layers of microfibrillated cellulose are located between the plies of the paper or board.

16. The process according to claim 12 wherein the paper or board ply has a solids content of between 7-13% by weight before the layer of microfibrillated cellulose is applied.

17. The process according to claim 12 wherein the layer of microfibrillated cellulose is applied by spraying.

18. The process according to claim 12 wherein the layer of microfibrillated cellulose is applied to the surface of the ply or plies in more than one step, thus forming at least two layers of microfibrillated cellulose between the plies.

19. The process according to claim 12 wherein the at least one additive is present and wherein the at least one additive is applied together with the layer of microfibrillated cellulose to at least one surface of a ply.

20. The process according to claim 12 further comprising applying at least one second additive selected from the group consisting of a filler, a strength enhancer, and starch to at least one surface of a ply.

* * * * *